United States Patent [19]

Corsette

[11] Patent Number: 4,624,413

[45] Date of Patent: Nov. 25, 1986

[54] TRIGGER TYPE SPRAYER

[76] Inventor: Douglas F. Corsette, 6559 Firebrand St., Los Angeles, Calif. 90045

[21] Appl. No.: 694,101

[22] Filed: Jan. 23, 1985

[51] Int. Cl.[4] ..... B05B 1/34; B05B 11/00

[52] U.S. Cl. ..... 239/333; 222/383; 239/461; 239/477

[58] Field of Search ..... 222/383, 484, 488; 239/333, 461, 464, 477

[56] References Cited

U.S. PATENT DOCUMENTS 1,843,411 2/1932 Woolley .
3,061,202 10/1962 Tyler .
3,596,808 8/1971 Corsette .
4,082,223 4/1978 Nozawa .
4,273,290 6/1981 Quinn ..... 239/333
4,310,107 1/1982 Wesner .
4,365,751 12/1982 Saito et al. .
4,489,861 12/1984 Saito et al. ..... 222/383 X

*Primary Examiner*—Andres Kashnikow
*Attorney, Agent, or Firm*—Watson, Cole, Grindle & Watson

[57] ABSTRACT

The trigger actuated pump sprayer has a nozzle cap which surrounds a unitary element and forms a spin chamber therewith, the element having an integrally connected spring and biased discharge check valve and including a plurality of supply channels, the nozzle cap being rotatable without axial displacement relative to the element and containing a plurality of tangential openings being arranged relative to the channels for controlling the swirl velocity in the spin chamber, upon cap rotation, and thus the pattern range of discharge through the discharge orifice from an OFF position.

13 Claims, 8 Drawing Figures

TRIGGER TYPE SPRAYER

BACKGROUND OF THE INVENTION

This invention relates generally to a manually operated dispenser in the form of a trigger sprayer having an adjustable spray feature, and more particularly to such a sprayer having a composite seal, discharge valve and spin chamber forming element in which spray adjustment is made without the need to enlarge the spin chamber.

Manually operated sprayers are known to have some type of adjustable spray arrangment at the nozzle end, such that a misting element cooperates with a threaded nozzle cap which, when axially displaced, effects adjustment of the ejected spray pattern as the spin chamber depth is varied. Gradual outward displacement of the nozzle cap, as in U.S. Pat. No. 3,061,202, produces a gradually coarser spray pattern and finally an ejected stream as the spin chamber is converted into a plenum chamber. The nozzle cap may be fully tightened to effect a fine mist spray, and complete tightening to achieve a discharge shut-off. And, a separate discharge valve, resiliently urged closed by a separate spring, extends from an inner end of the misting element.

In U.S. Pat. No. 4,082,223, the discharge valve and closing spring form a one-piece element with a base plate containing radially extending and axially extending slots leading toward the discharge orifice of a threaded nozzle cap to effect a fine mist spray. An adjustable spray pattern is not provided, though a complete discharge shut-off is possible on complete tightening of the nozzle cap.

U.S. Pat. No. 1,843,411 provides for varying the capacity of a liquid fuel burner by successively closing one or more atomizer ports of an atomizer element, through an external adjustment, a segmented rotatable shutter is actuated to close or open the ports leading to tangential ducts in the atomizer element. The spray capacity through the discharge orifice is thereby varied as the discharge is throttled through the discharge orifice.

It is desirable to provide an alternative to those manually operated sprayers requiring axial displacement of the nozzle cap for changing the swirl velocity to vary the liquid ejection pattern, but without enlarging the depth of the swirl chamber and thereby avoiding an unsightly gap between the nozzle cap and adjoining pump body as well as inadvertent removal of the nozzle cap while at the same time providing for a complete discharge shut-off during conditions of non-use.

SUMMARY OF THE INVENTION

It is therefore an object of this invention to provide a manually operated sprayer having at the nozzle end a spring biased discharge valve/spin chamber forming a composite cooperating with tangential openings located in a rotatable nozzle cap for adjusting the spray pattern upon cap rotation but without axial displacement. The swirl velocity in the spin chamber is thereby varied for altering the liquid ejection pattern without enlarging the depth of the spin chamber and without varying the capacity or volume of discharge.

Another object of the present invention is to provide such a sprayer wherein the composite has a plurality of spaced apart feed channels leading into the spin chamber, and an engageable portion of the nozzle cap contains the tangential openings leading to the spin chamber, the openings and the channels being relatively arranged for controlling the swirl velocity in the spin chamber and thus the pattern range of liquid ejected from the discharge orifice upon cap rotation.

A further object of this invention is to provide such a sprayer wherein the channels in the composite are differently sized, and the tangential openings in the nozzle cap are equally sized and equally spaced apart for selectively matching and mismatching the channels in relative rotative positions of the cap.

Other objects, advantages and novel features of the invention will become more apparent from the following detailed description of the invention when taken in conjunction with the accompanying drawings

DETAILED DESCRIPTION OF THE INVENTION

Figure 1:
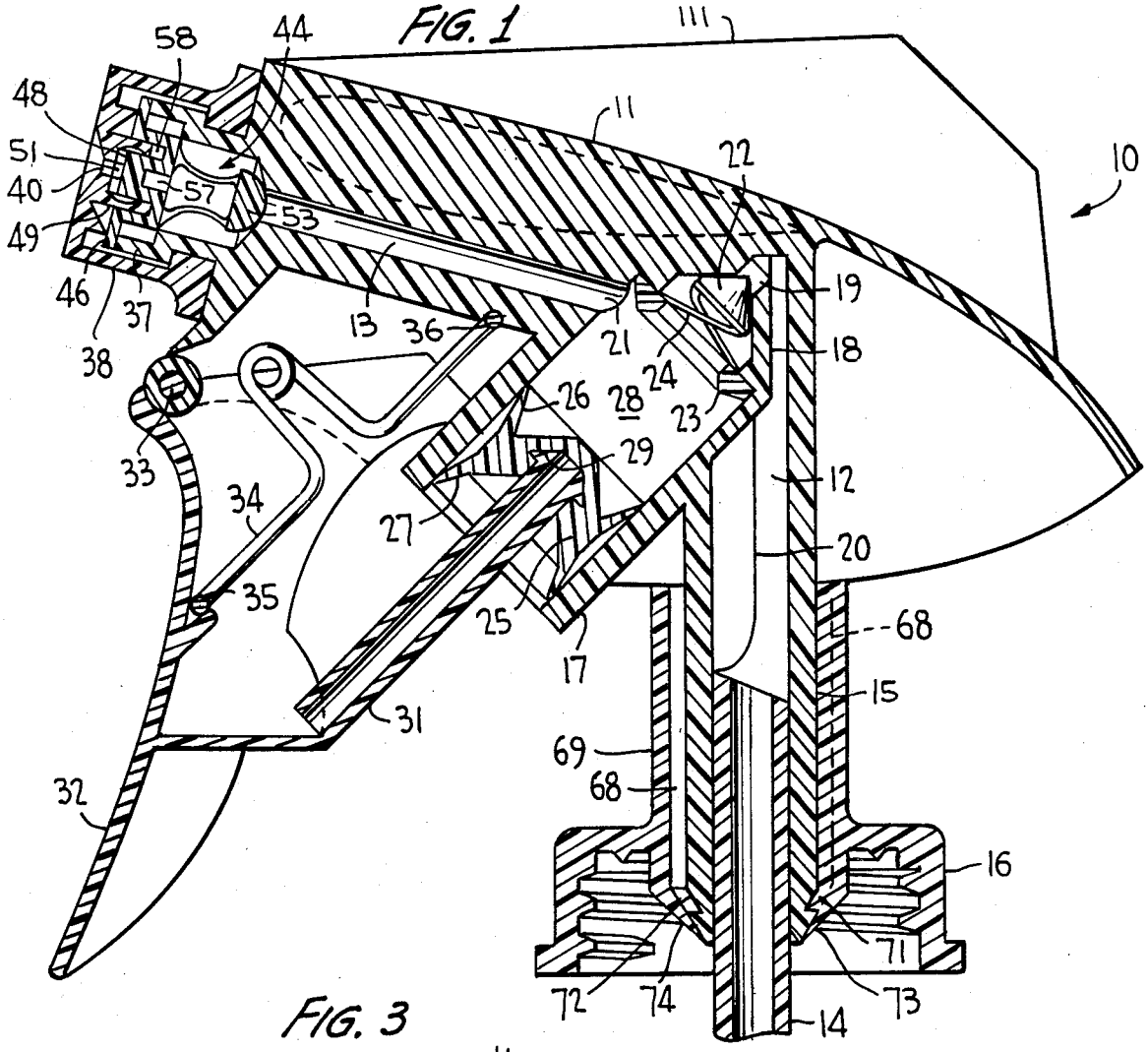
FIG. 1 is a vertical sectional view of a trigger sprayer which includes the variable discharge spray arrangement according to the invention.

Turning now to the drawings wherein like reference characters refer to like and corresponding parts throughout the several views, a manually operated liquid dispenser is shown in FIG. 1 in the form of a trigger operated sprayer 10 having a pump body 11 which includes an inlet passage 12 and a discharge passage 13. A conventional dip tube 14 is received within a shank 15 of the pump body and extends into a container (not shown) of product to be dispensed in a manner well known in the art. A container cap 16, having internal threads or other container securement means, is integral with or otherwise secured to the pump body for mounting the sprayer onto the neck of the container. Stop means which may be in the form of an axial rib 20, an offset of the inlet bore, an internal shoulder, or the like, on the pump body may extend into the inlet passage for limiting the extent of the dip tube within the pump body shank.

The pump body further includes a pump cylinder 17 having an inner end 18, which may be conical as shown, containing an inlet port 19 in communication with inlet passage 12. As can be seen, the pump cylinder lies at an angle to the inlet and discharge passages, and an outlet port 21 is located in the annular wall of the pump cylinder adjacent the inlet end, the outlet port communicating with the discharge passage. And, a central dorsal fin 111 may be provided on the pump body, to support top loads without adverse force couples.

The intake valve may be in the form of an inlet check valve 22 of conical configuration for seating against the inner surface of end 18 in an intake valve closing position of FIG. 1. A retaining ring 23 is integrally connected to check valve 22 via spring legs 24, the retaining ring being secured in place within the pump cylinder either through a frictional fit with the wall of the pump cylinder, or by means of snap beads or the like provided on the cylinder wall.

A ring-shaped piston 25 is operable for reciprocating movement within the pump cylinder, and has flexible, circular skirts 26 and 27 at opposite ends adapted for sliding along the inner surface of the pump cylinder in fluid tight engagement therewith. The piston therefore defines a variable volume pump chamber 28 with the pump cylinder. And, the piston has an outwardly open central bore 29 which is undercut for snap fitting engagement with a piston rod 31 having a head configured for snap fitting engagement with the undercut of bore 29. The piston rod is shown integrally connected with a trigger actuator in the form of a lever 32 which is hinged to the pump body as at 33. An external spring 34 , having its opposite ends mounted as at 35 and 36 to the lever and the pump body, functions as a spring return for the pump piston upon operation of the trigger actuator. Otherwise, an internal, coil return spring (not shown) may be disposed within the pump cylinder between the pump piston and ring 23 for spring biasing the pump piston outwardly of the pump cylinder.

It should be pointed out that, in lieu of check valve 22, spring legs 24 and retainer ring 23, an inlet ball check valve can be suitably located within passage 12, or an inlet flap valve could be provided, as alternatives for valve controlling the inlet.

The pump body includes a nozzle boss 37 which forms a continuation of discharge passage 13, and a nozzle cap 38 is mounted on boss 37 for rotation about its central axis. As more clearly shown in FIG. 3, an internal annular snap bead 39 on the nozzle cap cooperates with an external annular snap bead 41 on boss 37 for retaining the nozzle cap in place while permitting relative rotation but without axial displacement. The nozzle cap may abut against a front shoulder 42 of the pump body, or may be slightly spaced therefrom. And, the nozzle cap may have a square external configuration, shown in FIGS. 4 to 7, with a modal marking 43 or the like on each one of its surfaces for indicating the operating mode or the OFF position.

A one-piece element 44 comprises a composite which includes a housing 45 having an annular flange 46 for engagement in sealing relation with the open end of nozzle attachment boss 37, and for mating with an annular undercut of the nozzle cap when snap-fitted on to the nozzle boss. Housing 45 has an annular groove 47 at the outer periphery of its outer surface 48 for the reception of an annular flange 49 of the nozzle cap. This outer surface 48 forms a circular spin chamber 51 with the confronting portion of the nozzle cap, the spin chamber being in open communication with a discharge orifice 40 of the nozzle cap.

Figure 3:
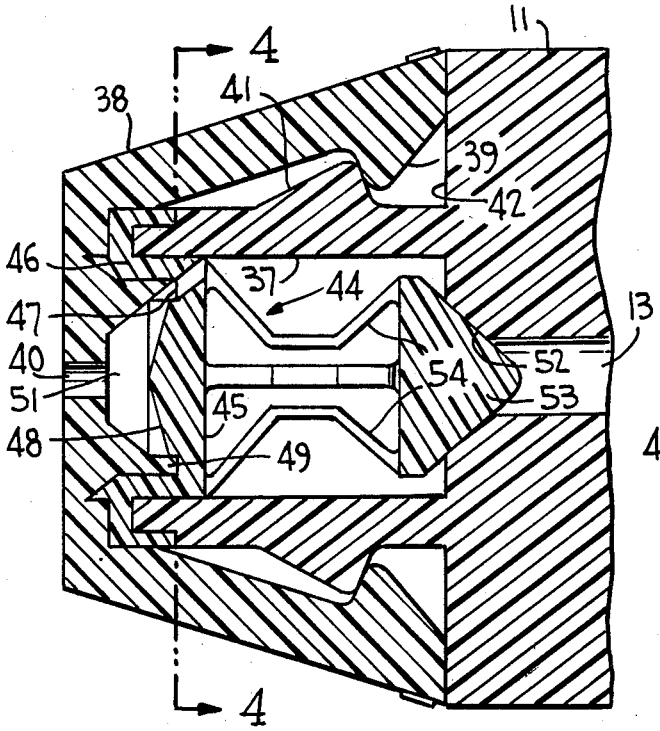
FIG. 3 is an enlarged vertical sectional view showing another slightly modified variable spray discharge arrangement according to the invention.

The terminal end of discharge passage 13 is shaped to define a conical or toroidal valve seat 52, and a discharge check valve 53, having a suitable valve surface, such as flat, conical, spherical, parabolic, etc., is shown seated against valve seat 52 in a discharge valve closing position of FIG. 3. A system of spring legs or strap springs 54 integrally connect check valve 53 to housing 45 for resiliently urging the discharge check valve into its discharge closing position.

Element 44 has, essentially at a location at which flange 46 joins housing 45, a plurality of supply channels 55, 56 and 57, as more clearly shown in FIGS. 4 to 7. Channels 55 and 56 are essentially of the same size, while channel 57 is slightly larger. All three channels lie along radial lines 1 (FIG. 4) having included angles of 120 degrees, although the lines do not respectively bisect each channel.

A plurality of three equally spaced openings 58, 59 and 61 are provided in flange 49 of the nozzle cap tangential to circular spin chamber 51 and shown disposed in the same direction. Thus, for illustration purposes, an equilateral triangle t can be drawn with the apices thereof respectively at the centers of all three openings.

Figure 4:
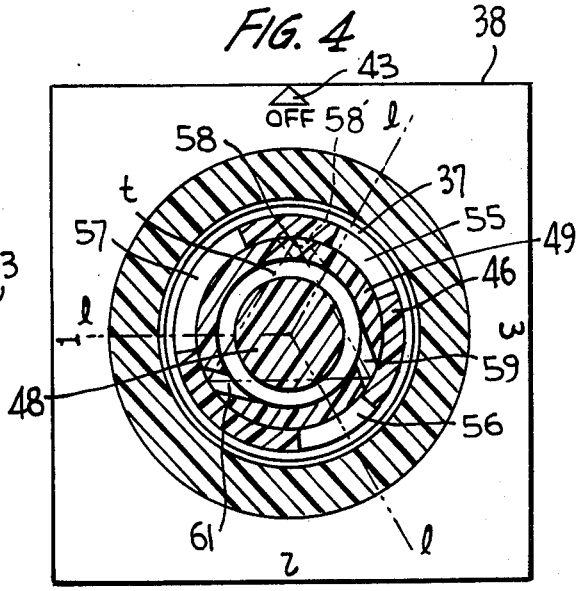
FIGS. 4 to 7 are views taken substantially along the line 4—4 of FIG. 3 showing a discharge shut off condition of FIG. 3 and relative rotative positions of the nozzle cap into one, two and three tangential open positions, respectively.

FIGS. 3 and 4 illustrate an OFF position in which tangential openings 58, 59 and 61 are out of radial alignment with any supply channel. In this position, marker 43 is located on an upper face of the nozzle cap, and a legend such as OFF may be provided on the nozzle cap adjacent the marker. Thus, in the relatively rotative position of the nozzle cap of FIG. 4, the discharge is completely sealed closed during non-use conditions of shipping, storage and handling, so that any leakage of product through the discharge is substantially avoided during these conditions even upon inadvertent operation of the trigger actuator. As will be seen, clockwise rotation (as viewed in FIG. 4) of the nozzle cap relative to the pump body, through 90 degrees, 180 degress and 270 degrees, FIGS. 5 to 7, respectively aligns one, two and three tangential openings with the supply channels of the element 44 for varying the spray pattern, upon an unseating of the discharge check valve, from a fine mist to coarser and still coarser or stream sprays. Markings such as 1, 2 and 3 may be applied on the flat external surfaces of the nozzle cap respectively at the 9, 6 and 3 o'clock positions as viewed in FIG. 4. Thus, upon manual rotation of the nozzle cap through 90 degrees clockwise from that of FIG. 4 to that of FIG. 5, the "1" marking is now uppermost indicating readiness for a fine mist spray in this FIG. 5 condition. It can be seen that only one of the tangential openings 61 is in radial alignment with a portion of supply channel 57, the other two tangential openings 58 and 59 being blocked. Thus, upon operation of the trigger actuator, and assuming a primed condition of the pump chamber, product is pumped by the piston through the discharge passage and, when the pressure of the product exceeds the return force of spring legs 54, discharge check valve 53 is unseated, product flows through boss 37 and is allowed to enter spin chamber 51 through channel 57 aligned with tangential opening 61. A constant volume of product entering the spin chamber controlled by the discharge orifice 40 is thereby accelerated as it passes through opening 61 and swirls within the spin chamber as a relatively high swirl velocity before exiting orifice 40 as a fine mist spray.

Figure 5:
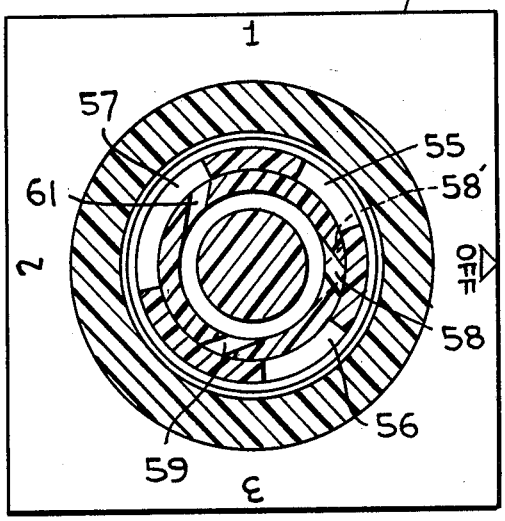
Figure 6:
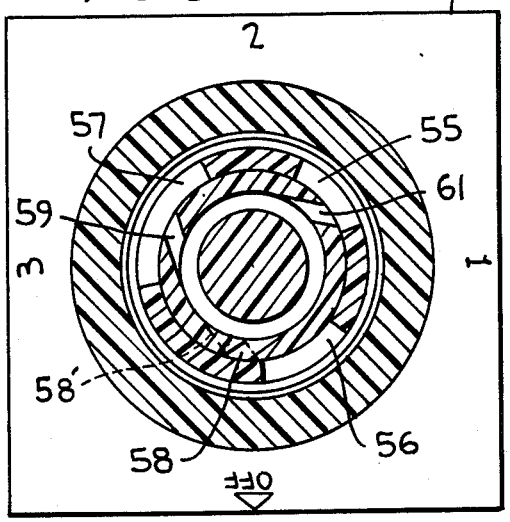

To effect a coarser spray, the nozzle cap is manually rotated clockwise through another 90 degree turn from that of FIG. 5 to that of FIG. 6 until marking "2" becomes uppermost in view of the operator. There, tangential openings 59 and 61 are in alignment with supply channels 57 and 55, while opening 58 is blocked. Thus, as pressurized product enters the spin chamber through the two open tangential openings 59 and 61 at essentially the same volume as before but now at a relatively lower swirl velocity, product exits discharge orifice 40 as a coarser spray as compared to that at the "1" setting. And, as the nozzle cap is further rotated clockwise through 90 degrees from that of FIG. 6 to that of FIG. 7, all three tangential openings 58, 59 and 61 are placed in radial alignment with supply channels 57, 55 and 56, so that a still coarser spray through the discharge orifice is effected upon a further reduced swirl velocity approximating a plenum chamber of pressurized product in the spin chamber before exiting.

It can be appreciated that the tangential openings and the supply channels can be relatively arranged and sized in a slightly different manner from that shown, without departing from the scope of the invention. For example, the supply channels may be differently sized from that shown so as to effect a smooth change in spray pattern between fine mist and coarse continuously between 90 degree turns. Or, it may be desirable to rotate the nozzle cap only through 90 degrees between OFF and coarse positions, or through only 180 degrees between these positions.

Figure 7:
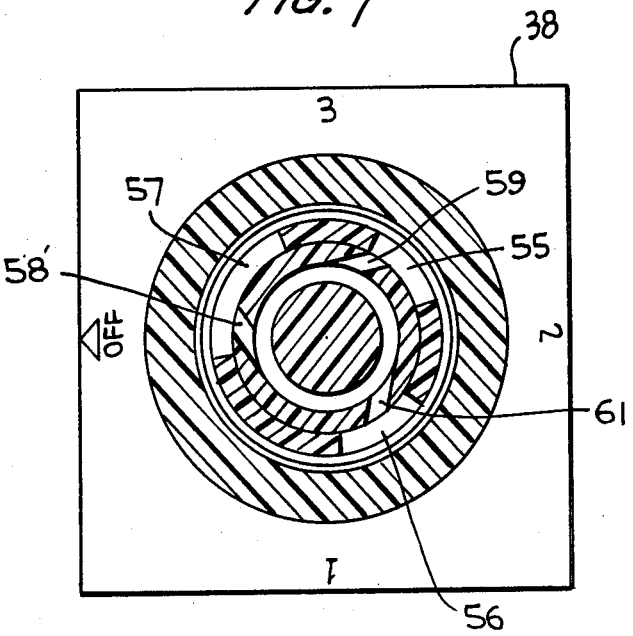
Figure 8:
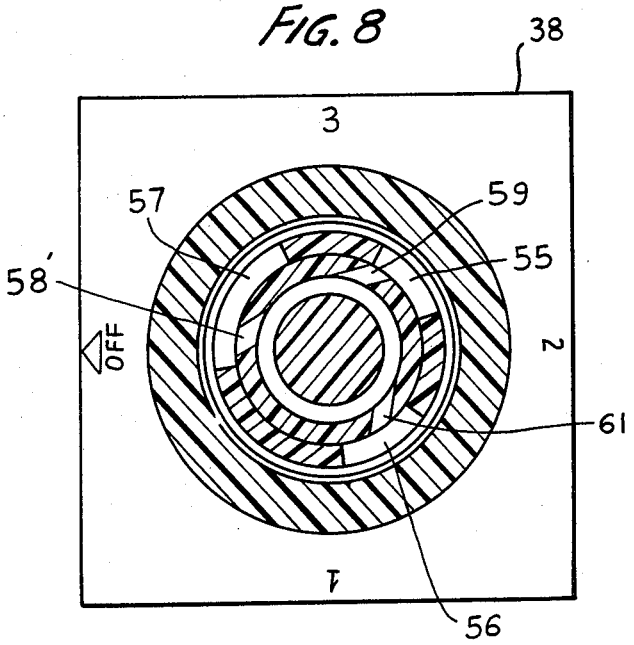
FIG. 8 is a view similar to FIG. 7 showing one of the tangential opening reversed relative to the other two.

As seen in FIGS. 4 to 7, tangential openings 58, 59. 61 extend in the same direction such that the liquid product flow therethrough is clockwise in the discharge open positions of FIGS. 5 to 7. The coarsest spray pattern achieved with such an arrangement approximates that of a stream discharge. Nevertheless, a pure stream discharge can be effected by providing one of the tangential openings 58' so as to extend in an opposite direction compared to that of openings 59 and 61, as shown in FIG. 8, and as shown in phantom outline in FIGS. 4 to 6. Thus, tangential opening 58' is disposed for counterclockwise rather than clockwise flow therethrough in the third discharge open position of FIG. 8. With such arrangeement, reversed tangential 58', when opened, serves to defeat the swirl within spin chamber 51 thus converting the swirl chamber into a plenum chamber from which product is discharged through discharge orifice 40 as a pure stream.

Element 44 shown in FIG. 1 is essentially the same as that shown in more detail in FIG. 3 except that, for example, discharge check valve 53 is part spherical rather than conical, and surface 48 of housing 45 extends farther into spin chamber 51, with a portion of the spin chamber surrounding a portion of the housing. Otherwise, the aforedescribed function and operation for effecting a pattern range of discharge through the discharge orifice, are the same.

Figure 2:
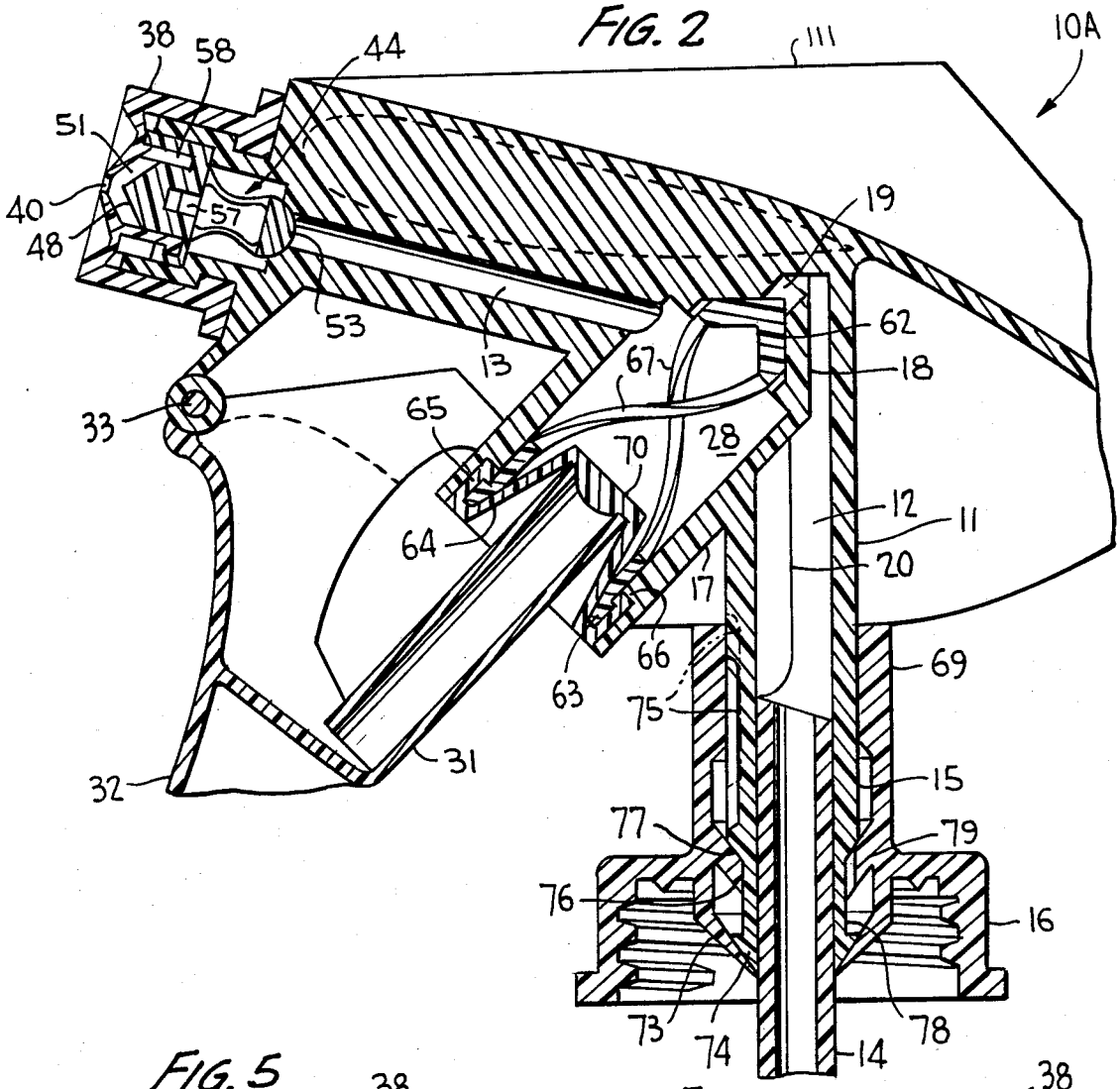
FIG. 2 is a view similar to FIG. 1 illustrating a slightly modified variable spray discharge according to the invention, and including an alternative pump piston and inlet check valve.

The FIG. 2 sprayer, generally designated 10A, is essentially the same as sprayer 10 except for the inlet check valve and pump piston. In this embodiment, an inlet check valve 62, having a valving surface for seating against a suitable valve seat in the end of pump cylinder 17 (mating conical configuration shown), includes a retainer ring 63 for retaining both the inlet valve and a seal cap 64, in place within the pump cylinder. An inwardly turned flange 65 of the seal ring engages an annular groove 66 in the pump cylinder and is retained therein by ring 63. Seal cap 64 not only seals pumping chamber 28 against leakage to the outside, but also performs the pumping function of a piston and spring. This pumping function is effected by the provision of a central diaphragm portion 70 of the seal cap which is depressed within the pump cylinder cavity within the envelope of integral spring legs 67 which interconnect the inlet check valve 62 with retainer ring 63 while the wall portion of seal cap 64 extends elastically. This seal cap 64 is stretched into the pump cylinder by the force applied by piston rod 31. Seal cap 64 is comprised of an elastomeric material such as, rubber, latex, or polyurethane plastic, as suited for the product to be dispensed. When the plunger force is released, the seal cap elastically returns to its unstressed condition, thus returning the piston rod and trigger 32 to a rest position, and effecting an intake stroke in the pump cylinder. Since elastomeric materials have a tendency to deteriorate when maintained in a stretched condition for extended periods, it is advantageous that the seal cap be in an unstressed condition when not in use. As the central diaphragm portion 70 of the seal cap is depressed within the cylinder upon operation of the trigger actuator, the pumping pressure will tend to form the wall portion of seal cap 64 over the piston rod. Rod 31 should, therefore, be sized to effect maximum displacement in the bore, be shaped to accommodate the stress patterns in the diaphragm, and the seal cap should have a variation in section thickness to maintain the stresses uniformly below critical levels in order to maximize the service life of the seal cap.

And, in FIG. 2, the conical shape of surface 48 is more pronounced, and the confronting portion of the nozzle cap is complementarily shaped to define a more uniform conical spin chamber 51 for a focusing effect on the spray discharge. Otherwise, the function as aforedescribed is the same.

In the FIG. 1 pump 10, at least one axial container vent groove 68 may be provided either in the inner surface of sleeve 69 of cap 16 as shown or on the outer periphery of shank 15. Such groove opens at its upper end and extends across a conical flange 71 provided on sleeve 69 which engages a mating annular recess 72. The pump body may thus be snap-fitted on to the container cap upon assembly from above. And, an annular lip or bunsen valve 73 of flexible elastomeric material on the container cap engages a leading conical end 74 of shank 15 which defines a valve seat for closing the container vent (as shown) to prevent outflow from the container through the vent bore when the pressure within the container exceeds atmospheric pressure. Also, valve 73 closes the container vent when the container is oriented away from an upright position whether the pressure within the container exceeds atmospheric pressure or not. As pressure within the container drops below atmospheric during the pumping operation, valve 73 unseats and air is vented into the container through the open vent groove 68 so as to permit equalization of pressures within and outside the container so as to replace the product dispensed from the container with air to avoid collapse of the container and a vacuum lock condition within the pump.

The engagement between shank 15 of the pump body and sleeve 69 of the container cap permits relative rotation between the members without affecting either the seal or the vent valve in their normal functions. And, such engagement provides the necessary stability and support for the pump body to prevent excessive distortion of the pump assembly in response to external forces.

Pump 10A of FIG. 2 may include a modified venting system in which an axial vent groove 75 on the outer periphery of shank 15 terminates below the upper end of sleeve 69 in the venting closing position shown. At its other end, the vent groove terminates short of a second conical bunsen valve 76 seated against a mating conical valve seat 77 provided on shank 15 at reduced section 78 thereof. At least one axial vent groove 79 is provided at the inner terminal end of valve 76. With such arrangement, axial movement of shank 15 within sleeve 69 is limited by opposite ends of reduced section 78 for positively opening and closing the vent groove or grooves. Thus, when the operator grasps the sprayer to put it into operation, the grip and weight of the container is sufficient to induce the necessary slight axial shift of shank 15 within sleeve 69 to open the upper end of groove 75 as this groove lies at its phantom outline position of FIG. 2. An open vent passage is therefore defined by groove 75 open at its opposite ends (shown in phantom), and by open groove 79 as valve 76 unseats from its seat 77. Valve 73 thus controls the vent passage similarly as described with reference to FIG. 1. The positive vent valve can be re-closed by pressing the pump body down to re-engage the seals shown in the FIG. 2 position, or the engagement between the shank and sleeve 69 may be caused to restore the seal if the fit between the two is sufficiently free. There would be no need to have a tight fit between parts 15 and 69 if vent valve 76 is properly controlled, and if the shipping valve 73 is automatically closed when not in use, and further held closed by the weight of the container if inverted. This vent valving can be accomplished without offsetting the feature of the assembly which permits the pump body to be rotated within sleeve 69 after being assembled to the container for purposes of orientation of the sprayer to some detail of the container, label, or carton member. The shank and the sleeve are permanently retained in assembled relation subject to relative rotation about their common axis, and limited axial movement to operate the vent valve as aforedescribed. The retention is effected as the mating end 74 of the shank is snapped beyond valve 76 during assembly.

The aforedescribed vent valving arrangement for pump 10A may, of course, be provided for pump 10 instead, or vice-versa.

From the foregoing, it can be seen that an arrangement for adjusting the discharge spray pattern for a manually operated trigger sprayer has been devised in a simple and efficient yet highly effective manner, and has reduced parts making it easy to assemble, economical to manufacture and easy to operate. The discharge valve composite is of a one-piece construction having an integrally connected spring biased discharge check valve, includes a housing containing a plurality of supply channels, has an annular flange thereon in sealing engagement with the tip end of a nozzle attachment boss, and sealingly engages a rotatable nozzle cap which surrounds both the discharge valve composite and the nozzle boss. Tangential openings provided in the nozzle cap are arranged relative to the feed channels so that, upon nozzle cap rotation, the discharge may be completely closed during non-use conditions, and a spray pattern through the discharge orifice may be varied between fine mist and coarse or stream sprays. The capacity or volume of discharge through the discharge orifice remains essentially constant when one, two or three tangentials are opened since throttling is effected through the discharge orifice, and swirl acceleration is induced by the open tangential or tangentials for changing the swirl velocity in the spin chamber without changing the capacity or size of the spin chamber. Thus, the nozzle cap is not axially displaced relative to the pump body, and a tight sealing engagement is thus maintained between the nozzle cap, the composite and the nozzle boss during the various spray settings.

Moreover, the invention gives rise to an infinitely variable spray pattern, and the spray pattern is capable of being controlled in accordance with the teachings of the invention between OFF positions upon nozzle cap rotation through less than a full 360 degree turn if desired, depending on the relative arrangement between supply channels and tangential openings. Thus, depending on the size and the relationship of the supply channels to the tangential openings, the spray pattern may be adjusted from an OFF position to fine spray, coarse spray and still coarser spray upon rotation in either direction through only 90 degrees or through only 180 degrees, or, depending on the specific relative arrangement between the supply channels and the tangentials, the discharge pattern is capable of being adjusted from an OFF position to spray upon a quarter clockwise turn, for example, of the nozzle cap, and from an OFF position to a stream upon, for example, a quarter counterclockwise turn of the nozzle cap. And, at least two and more than three supply channels and tangential openings can be optionally provided without departing from the invention.

Furthermore, element 44 may include a discharge check valve other than the type disclosed, without departing from the invention, so long as the check valve is spring biased against its valve seat in a discharge closing position. And, other pump pistons, piston resilient return means and inlet check valves other than those disclosed, may be provided for the pump sprayers according to the invention.

Obviously, many other modifications and variations of the present invention are made possible in the light of the above teachings. It is therefore to be understood that within the scope of the appended claims the invention may be practiced otherwise than as specifically described.

What is claimed is:

1. A liquid dispensing pump, comprising a pump body adapted to be mounted on a container of flowable product to be dispensed, said body having a pump cylinder, a piston reciprocable in said cylinder and therewith defining a variable volume pump chamber, said pump body having valve-controlled inlet and outlet means for delivering liquid product into and out of said pump chamber, means for manually reciprocating said piston, a nozzle cap having a discharge orifice and being mounted for rotation between a discharge closed position and at least two selective discharge open positions without axial displacement on said pump body at the end of said outlet means, an element disposed within said nozzle cap and mounted on said pump body, said nozzle cap having an inner surface, and said element comprising a housing having an outer surface spaced from said inner surface to therewith define a circular spin chamber, a wall of said nozzle cap engaging a wall of said housing, said cap wall having at least two spaced apart tangential openings at said inner surface leading into said spin chamber, said housing wall having at least two spaced apart supply channels, said openings and said channels solely comprising discharge flow path means and being relatively arranged such that upon rotation of said cap into said discharge closed position said openings and said channels are mismatched, upon rotation of said cap into a first of said discharge open positions one of said channels and one of said openings are matched, and upon rotation of said cap into a second of said discharge open positions of both of said channels and both of said openings are matched, whereby the liquid product is discharged through said discharge orifice at an essentially constant discharge capacity solely via said tangential openings at a swirl velocity and in a pattern range depending on said discharging open positions.

2. The pump according to claim 1, wherein said piston comprises a seal cap in fluid tight engagement with one end of said pump cylinder, said seal cap being of elastomeric material which extends elastically into said pump chamber during pumping.

3. The pump according to claim 1, wherein said pump body includes a hollow shank defining said intake passage, a container cap having a sleeve surrounding said shank, cooperating means on said shank and said sleeve preventing relative axial shifting therebetween but permitting relative rotation, a vent passage open at one end defined between said shank and said sleeve, an annular vent valve of flexible elastomeric material on said sleeve and normally seated against a valve seat defined on said shank at an opposite end of said passage for closing same, said vent valve moving away from said valve seat for opening said passage in response to a decrease in pressure within the container.

4. The pump according to claim 1, wherein said pump body includes a hollow shank defining said intake passage, a container cap having a sleeve surrounding said shank, cooperating means on said shank and said sleeve permitting relative rotation and limited relative axial movement, a vent passage closed at one end defined between said shank and said sleeve, an annular vent valve on said sleeve normally seated against a valve seat defined on said shank at an opposite end of said passage for closing same, said passage being positively open upon said relative axial shifting.

5. The pump according to claim 1, wherein said channels are differently sized and said tangential opens are equally spaced apart.

6. The pump according to claim 1, wherein said cap is mounted for rotation between said discharge closed position and at least three selective discharge open positions, said wall of said cap having at least three of said openings and said wall of said housing having at least three of said channels, such that in said first discharge open position one of said channels and one of said openings are matched, in said second discharge open position two of said openings and two of said channels are matched, and in a third of said discharge open positions all of said channels and all of said openings are matched.

7. The pump according to claim 6, wherein said channels are differently sized and said tangential openings are equally spaced apart.

8. The pump according to claim 6, wherein two of said tangential openings extend in a first direction, and the third of said openings extends in a direction opposite said first direction so as to defeat the swirl within said spin chamber to thereby effect an essentially stream discharge.

9. The pump according to claim 1, wherein said outlet means includes a discharge valve seat, and said element includes an integral, self spring-biased discharge check valve resiliently seated against said valve seat when charging said pump chamber during piston suction strokes.

10. The sprayer according to claim 9, wherein said element includes at least one strap spring which integrally connects said discharge check valve to said housing.

11. The pump according to claim 10, wherein said element includes a plurality of strap springs which integrally connect said discharge check valve to said housing.

12. The pump according to claim 1, wherein said tangential openings extend in opposite directions so as to defeat the swirl within said spin chamber to thereby effect an essentially stream discharge.

13. The pump according to claim 1 wherein said wall of said nozzle cap comprises an annular flange containing said openings, and said housing having a groove which rotatively receives said flange, said channels being disposed in said groove.

* * * * *